US008132497B2

(12) United States Patent
Darbois et al.

(10) Patent No.: US 8,132,497 B2
(45) Date of Patent: Mar. 13, 2012

(54) HYDRAULIC MACHINE, IN PARTICULAR HYDRAULIC MOTOR, AND METERING DEVICE COMPRISING SUCH A MOTOR

(75) Inventors: Matthieu Darbois, Bordeaux (FR); Grégory Lucas, Saint Loubes (FR); Gilbert Barras, Carignan de Bourdeaux (FR); Dominique Berton, Le Bouscat (FR)

(73) Assignee: Dosatron International, Tresses (FR)

( * ) Notice: Subject to any disclaimer, the term of this patent is extended or adjusted under 35 U.S.C. 154(b) by 915 days.

(21) Appl. No.: 12/160,428

(22) PCT Filed: Dec. 7, 2006

(86) PCT No.: PCT/FR2006/002674

§ 371 (c)(1),
(2), (4) Date: Jul. 10, 2008

(87) PCT Pub. No.: WO2007/080250

PCT Pub. Date: Jul. 19, 2007

(65) Prior Publication Data

US 2010/0154625 A1 Jun. 24, 2010

(30) Foreign Application Priority Data

Jan. 13, 2006 (FR) ..... 06 00314

(51) Int. Cl.
*F01L 31/02* (2006.01)

(52) U.S. Cl. ..... 91/346

(58) Field of Classification Search ..... 91/330, 91/341 R, 344, 346, 350
See application file for complete search history.

(56) References Cited

U.S. PATENT DOCUMENTS

| | | | | |
|---|---|---|---|---|
| 5,363,739 | A * | 11/1994 | Sydow | 91/346 |
| 6,684,753 | B1 | 2/2004 | Urrutia | |
| 6,910,405 | B2 * | 6/2005 | Walton et al. | 91/330 |
| 7,207,260 | B2 | 4/2007 | Thierry et al. | |
| 7,975,597 | B2 * | 7/2011 | Darbois et al. | 91/346 |

FOREIGN PATENT DOCUMENTS

| | | |
|---|---|---|
| EP | 1 151 196 B | 8/2000 |
| FR | 2 607 194 A | 5/1988 |
| WO | 2004/051085 A1 | 6/2004 |

* cited by examiner

*Primary Examiner* — Michael Leslie
(74) *Attorney, Agent, or Firm* — Young & Thompson

(57) ABSTRACT

A hydraulic machine includes a casing with a body and a cover; a separation member which can make a reciprocating movement and defines two chambers; hydraulic switching elements including a distribution member; a compartment in the body of the casing connected to a pressurized-liquid inlet, and initiating elements including a pusher connected to the separation member, these initiating elements being able, at the end of the stroke, to cause a sudden change in the position of the switching elements, under the action of an elastic member to reverse the stroke. The distribution member has a distribution slide valve applied against a flat plate which is fixed relative to the body of the casing, the slide valve being able to slide in a fluid-type manner, without a seal, against the plate, which has orifices connected respectively to the chambers and to a liquid outlet orifice.

20 Claims, 3 Drawing Sheets

HYDRAULIC MACHINE, IN PARTICULAR HYDRAULIC MOTOR, AND METERING DEVICE COMPRISING SUCH A MOTOR

The invention relates to a hydraulic machine, in particular a hydraulic motor, of a type like those that comprise:

- a casing comprising a body and a cover;
- a separation means suitable for making an alternating movement in the casing between the body and cover, this separation means defining two chambers;
- hydraulic switching means for the supply with liquid and the emptying of the chambers, these switching means comprising a distribution member that is able to take two stable positions and is controlled by the movements of the separation means;
- a compartment in the body of the casing connected to a pressurized liquid inlet and in which the switching means are housed,
- and triggering means, comprising a pushbutton connected to the separation means, suitable for initiating, at the end of travel, a sudden change of the position of the switching means, under the action of an elastic means, for the inversion of travel.

The hydraulic machines of this kind, particularly the hydraulic motors for proportional metering devices, operate for the most part with a distribution system of the "valve box" type. The valve box is a fluid distribution system consisting of an inlet and exhaust valve through a working chamber, the valves being furnished with seals.

Such a type of distribution imposes an architecture and a geometry on the hydraulic machine, and on the proportional metering device incorporating such a hydraulic machine, creating problems for maintenance. Specifically, the installation and removal of such a valve box is often difficult because of a narrow access and often makes it necessary to remove other elements of the metering device. In addition, it is practically inevitable to have to replace the valve seals during the lifetime of the metering device.

The principal object of the invention is to provide a hydraulic machine, particularly a hydraulic motor, whose switching means make it possible to clearly separate the distribution mechanism from the drive portion, so that these elements can be removed independently of one another.

A further object of the invention is to reduce the number of parts comprising the machine, in particular at the switching means, and to reduce the maintenance operations.

According to the invention, a hydraulic machine, particularly a hydraulic motor, of the kind defined above is characterized in that the distribution member comprises a distribution slide valve pressed against a flat plate that is fixed relative to the body of the casing, the distribution slide valve being able to slide sealingly, without a seal, against the plate which comprises orifices connected respectively to the chambers of the casing and to an orifice for the outlet of the liquid, the distribution slide valve being provided in order, depending on its position, to close certain of the orifices or place them in communication with the fluid inlet or the exhaust.

The elastic means consists advantageously of a spring in the shape of an arc of a curve of which one end is connected to a link rod articulated on a shaft supported by the body of the casing, one end of the link rod being connected to the pushbutton, while the other end of the spring is connected in translation to the slide valve, this other end moving from one stable position to another stable position by deformation of the spring.

Preferably, the link rod is fixedly attached to at least one arm pressing against a stop of the slide valve at the time of the inversion of the direction of movement in order to assist the force of the spring at the beginning of the movement of the slide valve.

The end of the spring in the shape of an arc of a curve connected to the pushbutton travels, during the movement of the pushbutton, from one side to the other of the shaft of articulation of the link rod. The end of the spring in the shape of an arc of a curve connected to the slide valve is received in a housing lying in the direction of movement of the slide valve.

The spring is advantageously made of plastic, and articulation pins provided at each end are molded in a single piece with this spring.

The flat plate preferably comprises five orifices spaced out in the direction of sliding of the slide valve, namely a central orifice connected to the outlet of the hydraulic machine and, on either side of the central orifice, two spaced out orifices connected to a chamber of the machine, the slide valve comprising at its longitudinal ends a means for shutting off an orifice of the plate and, between its ends, a space for communication between at least two orifices of the plate. Preferably, the spacing between the central orifice and an adjacent orifice of the plate is less than the spacing between this adjacent orifice and the end orifice situated on the same side, the communication space of the slide valve ensuring, during the inversion of the direction of movement of the separation means, that the two chambers are placed in communication with the outlet and hence that the inlet is placed in communication with the outlet.

Each means for shutting off the distribution slide valve comprises a shutoff zone delimited by two walls transverse to the direction of movement, suitable for closing an orifice of the plate when it is in line with this orifice, and the communication space of the distribution slide valve, comprised between the shutoff zones, is limited by a wall at a distance from the plate.

The distribution slide valve and the flat plate are placed parallel to the direction of movement of the pushbutton. Preferably, the surface of the flat plate in contact with the slide valve is a glass sheet. The flat plate may be made of ceramic. The slide valve may be made of plastic.

The separation means is advantageously a membrane.

The invention also relates to a proportional metering device for an additive in a main liquid, characterized in that it comprises a hydraulic motor as defined above, and an additive-metering subassembly actuated by the motor.

The metering device may comprise a separation plug provided in the bottom of the compartment containing the switching means, this plug being traversed by a piston of the metering subassembly connected to the pushbutton and a pipe emerging beneath the plug and connected to the outlet.

Apart from the arrangements explained above, the invention consists of a certain number of other arrangements that will be more explicitly explained below with reference to an exemplary embodiment that is described with reference to the appended drawings but that is in no way limiting. In these drawings.

Figure 1:
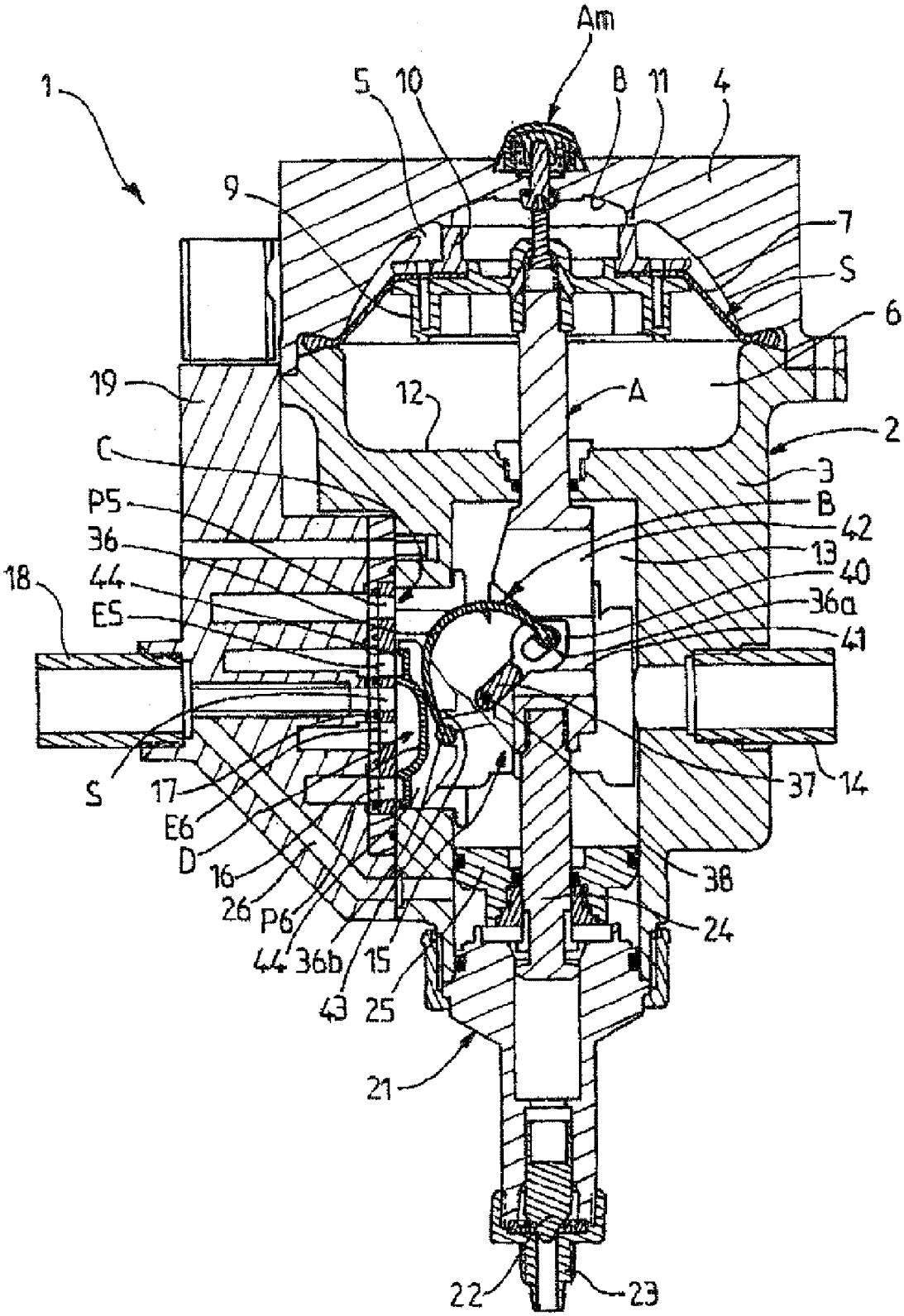
FIG. 1 is a schematic vertical section of a proportional metering device with a hydraulic motor according to the invention.
Figure 2:
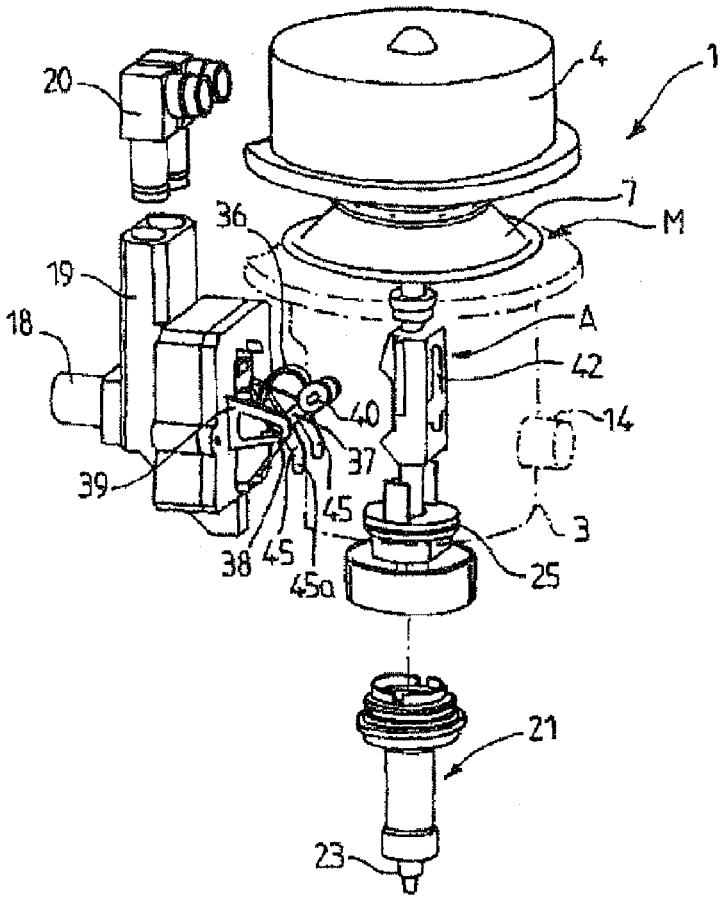
FIG. 2 is an exploded view in perspective of the main parts of the metering device and of the hydraulic motor.

With reference to the drawings, in particular FIGS. 1 and 2, it is possible to see a proportional metering device comprising a hydraulic motor 1, for a metered injection of additive into a main liquid that actuates the motor. The motor 1 comprises a casing 2 formed of a body 3 and a cover 4. The body and the cover are assembled in a removable manner, by bolts and nuts not shown, passing through holes provided in twinned flanges. The cover 4 is fitted with a bleed Am to exhaust the air from the metering device.

A separation means M suitable for carrying out an alternating movement, in a volume comprised between the body 3 and the cover 2, defines two chambers 5 and 6. The separation means M advantageously consists of a deformable membrane 7 whose periphery comprises a rim gripped in a sealed manner between the cover 4 and the body 3. This exemplary embodiment of the separation means M is not limiting, the invention being able to apply to a machine whose separation means consists of a piston.

The chamber 5, situated above the membrane 7 when the motor is placed with its vertical axis as illustrated in FIG. 1, is limited by an internal concave surface 8 of the cover 4. The central portion of the membrane 7 comprises a circular opening whose edge is gripped in a sealed manner between a disk 9 housed essentially in the chamber 6 and a ring 10 housed in the chamber 5. The ring 10 may, at the top end of travel of the membrane 7, press against a rib 11 of the internal surface 8.

The chamber 6 is delimited, on the side opposite to the membrane 7, by a cylindrical cavity whose bottom 12 comprises a passageway for a pushbutton A.

Hydraulic switching means C are provided in order to supply with liquid and empty the chambers 5 and 6. These switching means C comprise a distribution member D that is able to take two stable positions and are controlled by the movements of the membrane 7.

The switching means C are housed in a compartment 13 of the body 3 of the casing, connected to a pressurized liquid inlet 14.

Triggering means 15, comprising the pushbutton A connected to the membrane 7, are suitable for causing at the top and bottom ends of travel a sudden change of the position of the switching means C under the action of an elastic means B, for the inversion of the travel of the membrane 7.

The distribution member D comprises a distribution slide valve 16 pressed against a flat plate 17 that is fixed relative to the body 3 of the casing.

The plate 17 consists of a glass sheet, that is to say that the surface of the plate 17 in contact with the distribution slide valve 16 has a high degree of flatness corresponding to a mirror polish. The twinned surface of the slide valve 16 also has a high degree of flatness, such that a leaktightness of contact with no seal is established between the glass sheet 17 and the slide valve 16. The plate 17 is advantageously made of ceramic while the slide valve 16 is made of plastic.

For the liquid to pass through, the plate 17 comprises five orifices spaced out in the direction of sliding of the slide valve 16, the vertical direction according to the example of FIG. 1.

The plate 17 and the slide valve 16 are placed parallel to the direction of movement of the pushbutton A and at right angles to the geometric axis of the inlet 14. The slide valve 16 may slide against the plate 17 parallel to the direction of movement of the pushbutton A.

The plate 17 comprises a central orifice S connected to the outlet 18 of the hydraulic machine and, on either side of the central orifice in the direction of movement of the slide valve, two spaced out orifices E5, P5 and E6, P6 connected via pipes provided in a part 19 attached against the body 3 of the machine. The part 19 is itself connected by two elbows 20 (FIG. 2) to the upper chamber 5. The connections with the lower chamber 6 are shown only partially.

The lower portion of the compartment 13 is open and receives a metering subassembly 21 with a suction valve furnished with an end-piece 23 to which a duct can be connected immersed in a receptacle (not shown) of additive sucked in a metered quantity. The metering subassembly 21 comprises a suction piston 24 coupled to the pushbutton A.

According to the example shown in FIG. 1, the piston 24 passes through a separation plug 25 provided in the bottom of the compartment 13. The additive liquid pumped by the piston 24 is discharged toward the outlet 18 through a pipe 26 which emerges beneath the plug 25. The mixing of the additive, pumped by the subassembly 21, with the main liquid arriving via the inlet 14 takes place at the outlet 18.

As a variant, the mixing of the additive and the main liquid could take place in the compartment 13 by removing the plug 25 and closing the pipe 26.

Figure 6:
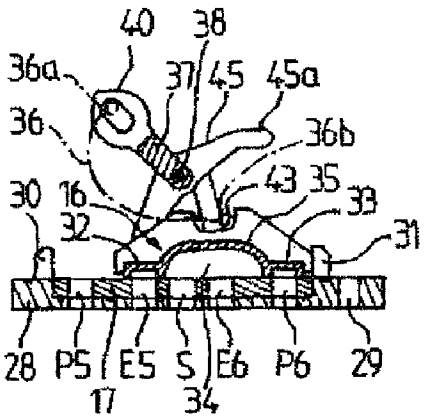
FIG. 6 is a schematic vertical section of the glass sheet and of the slide valve shown horizontally, in an extreme position.

As can be seen in FIG. 6, the plate 17 is housed in a recess 27 provided in a block 28 made of plastic comprising holes 29 for attachment to the part 19, and end-of-travel stops 30, 31 for the slide valve 16.

The spacing between the central orifice S and the plate 17 and an adjacent orifice E5 or E6 is less than the spacing between this orifice E5 or E6 and the end orifice P5 or P6 situated on the same side. The pitch between the orifices is therefore shifted, which has a value that is explained below.

The slide valve 16 comprises, at each of its longitudinal ends, a shutoff means comprising a zone 32, 33 for shutting off an orifice of the plate 17 and, between the shutoff zones, a space 34 for communication between at least two orifices of the plate 17.

Each shutoff zone 32, 33 of the slide valve 16 is delimited by two walls transverse to the direction of movement, ensuring a virtually linear contact with the plate 17, favorable to the establishment of a good seal. Between the transverse walls of pressure against the plate 17, the wall of the shutoff zones 32, 33 is parallel to the plate 17 and at a distance from its surface. The communication space 34 situated between the shutoff zones 32, 33 is limited by a dome-shaped wall 35.

The elastic means B consists of a leaf spring 36 in the shape of an arc of a curve whose convexity is turned toward the upper portion of the body 3. One end 36*a* of the spring is connected to the pushbutton A while the other end 36*b* is connected in translation to the slide valve 16. Each end 36*a*, 36*b* is advantageously formed by a cylindrical pin whose generatrices are orthogonal to the mid-plane of the leaf spring 36, and to the direction of movement of the pushbutton A, these cylindrical pins forming articulation shafts. The spring 36 is preferably made of plastic in a single piece with the pins 36*a*, 36*b*. The pins of the ends 36*a*, 36*b* protrude transversely on either side of the leaf spring 36 along its width.

The lateral protrusions of the end 36*a*, as can be seen in FIG. 2, are received in respective housings provided at one end of two parallel branches of a link rod 37, these branches framing the spring 36. Each housing receiving the end 36*a* is open so that the end 36*a* can be easily engaged in and disengaged from the housings of the link rod 37 by simply deforming the spring 36.

The link rod 37 is articulated, at its end distant from 36*a*, on a shaft 38 supported, at each of its ends, by an element 39 (FIG. 2) substantially in the shape of an isosceles triangle, with an internal opening, whose base is fixedly attached to the part 19 and the body 3, and whose top zone comprises a bearing for the end of the shaft 38. The two supports 39 frame the slide valve 16 and the link rod 37.

The end of each branch of the link rod 37 opposite to the shaft 38 and to which the end 36*a* of the spring 36 is attached comprises a cheek 40 in which a housing for the end 36*a* is provided. Each cheek 40 has a substantially circular shape and is housed, with the ability to rotate, in a horizontal groove 41. Each groove 41 is provided in a vertical inner wall of a rectangular window 42 arranged in the portion of the pushbutton A that is in the compartment 13. Each groove 41 opens, on the side of the plate 17, through a flared portion allowing an inclination of the link rod as illustrated in FIG. 1.

When the cheeks 40 are operated in translation by the pushbutton A, this arrangement allows the link rod 37 to rotate about the shaft 38.

The other end 36*b* of the spring 36 is received in a rectangular housing 43, lying in the direction of movement of the slide valve 16. Such a housing 43 is provided in each of the two side walls 44 of the slide valve 16, which frame the spring 36. The housing 43 is open in the direction opposite to the plate 17 and the force of the spring 36 presses the end 36*b* against the bottom of the housing 43. The installation of the pin forming the end 36*b* into the housing 43 is simple and quick, as is the removal.

Figure 12:
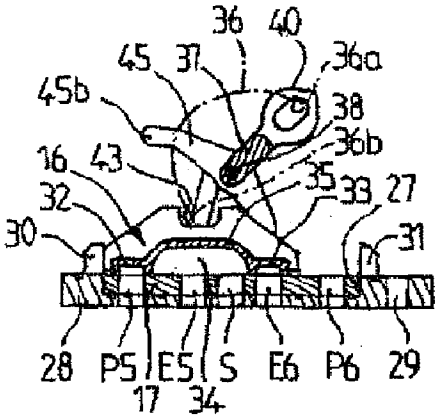
FIG. 12 is a schematic section similar to FIG. 10 of the link rod and the slide valve in another extreme position for controlling the inversion and the change of direction of the liquid flows.
Figure 7:
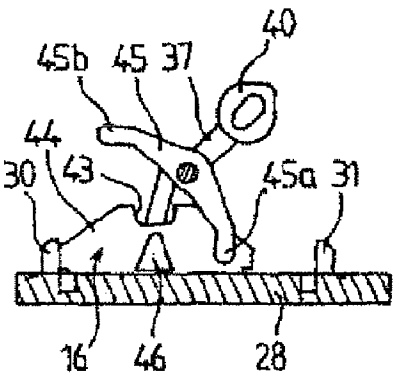
FIG. 7 is a view in elevation of the slide valve and the link rod of FIG. 6.

The end 36*b* may occupy a stable position illustrated in FIG. 1 and FIG. 12 in which it is butting against the transverse wall of the housing 43 furthest from the chamber 6. The slide valve 16 then occupies the bottom position illustrated in FIG. 1. In another stable position represented in FIG. 6, the end 36*b* of the spring is pressing against the transverse wall of the housing 43 closest to the chamber 6, and the slide valve 16 occupies the top position opposite to that of FIG. 1.

The end 36*a* of the spring connected to the pushbutton A by the link rod 37 travels, during the vertical movement of the pushbutton, from one side to the other of the articulation shaft 38 of the link rod 37. This travel triggers the switching and the change of position of the slide valve.

The link rod 37 is fixedly attached to at least one arm substantially orthogonal to the link rod and extending on either side of this link rod as can be seen in FIGS. 6 to 13. The arm 45 has the shape of a walking beam whose ends 45*a*, 45*b* are bent and rounded in order to come into contact, at the moment of inversion of the movement of the membrane, with a stop 46, for example in the shape of a prism, provided to protrude on the outer face of the side wall 44 of the slide valve, mid-way along, beneath the rectangular housing 43.

Preferably, two parallel arms 45 are provided and frame the slide valve 16, in order to press simultaneously against the stops 46.

Figure 3:
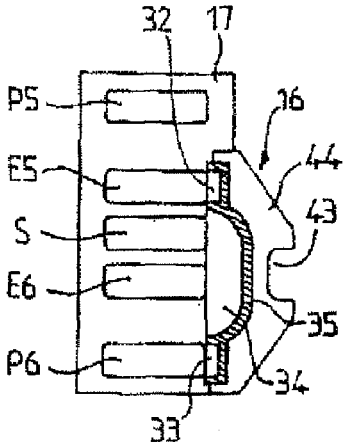
FIG. 3 is a diagram illustrating a first extreme position of the glass sheet and of the slide valve turned over on the side in order to make the explanations easier.
Figure 4:
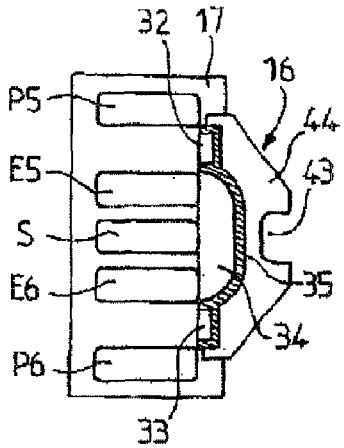
FIG. 4 shows, like FIG. 3, the glass sheet and the slide valve in an intermediate position.
Figure 5:
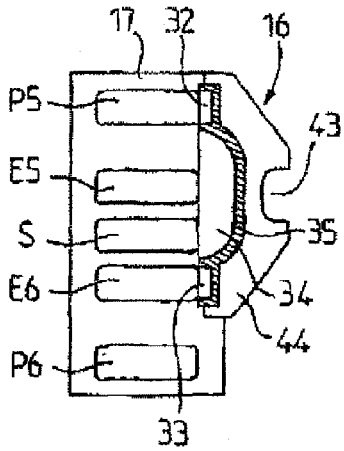
FIG. 5 shows, like FIG. 3, the glass sheet and the slide valve in another extreme position, opposite to that of FIG. 3.

The switching phases obtained with the slide valve 16 and the plate 17 are illustrated in FIGS. 3, 4 and 5. To make the drawings easier to understand, the slide valve 16 has been shown turned over whereas, in reality, it slides against the plate 17 in a position orthogonal to that shown in these figures. The width of the slide valve 16 is greater than that of the orifices of the plate 17 so that, when an orifice is covered by one of the end shutoff zones 32 or 33 of the slide valve, this orifice is completely closed.

FIG. 3 represents a first extreme stable position of the slide valve 16 in which the shutoff zone 32 closes the orifice E5 connected to the chamber 5, while the shutoff zone 33 closes the orifice P6 connected to the chamber 6. The intermediate space 34 places the orifice E6, and hence the chamber 6, in communication with the fluid outlet S. The orifice P5 of the plate 17 is open and receives the pressurized liquid that arrives in the compartment 13 and is directed toward the chamber 5.

FIG. 4 represents an intermediate position of the slide valve 16 in which the shutoff zones 32, 33 are in line with the separation zones between the two orifices situated on either side of the central orifice S of the plate 17. The orifices P5 and P6 communicate with the compartment 13 so that the pressure is accepted both in the chamber 5 and in the chamber 6. The space 34 causes the two exhaust orifices E5, E6 to communicate with the outlet orifice 5. In this intermediate position, the five orifices are in complete communication and are all open at full section. The flow of liquid passes through the chambers 5 and 6 and the pressures balance out on either side of the membrane 7.

FIG. 5 represents the other extreme stable position of the slide valve 16 in which the orifice P6 is open and receives the pressurized fluid that is directed toward the chamber 6. The orifices E6 and P5 are closed by the slide valve 16, while the orifice E5 is placed in communication with the outlet S.

The shifted pitch on the one hand between the outlet orifice S and the orifices E5, E6 and, on the other hand, between these orifices E5, E6 and the orifices P5, P6 makes it possible, in the extreme stable position of the slide valve 16, never to place the inlet pressure in communication with the outlet chamber, while, in the intermediate position of FIG. 4, all the orifices are in communication without restriction in order to cause the pressure on either side of the membrane 7 to fall.

The operation of the hydraulic motor and of the metering device according to the invention is explained with reference to FIGS. 1 and 6 to 13.

According to FIG. 6, the membrane 7 has reached the bottom end of travel and the link rod 37 has switched over, under the action of the spring 36, which has moved the distribution slide valve 16 into the top stable position pressing against the stop 30. In this position of the slide valve 16, the pressurized water arriving through the inlet 14 is admitted via the open orifice P6 into the bottom chamber 6. The other orifice E6 communicating with this chamber 6 is closed, while the orifice E5 is connected to the outlet 18. The pressure that is applied in the chamber 6 on the membrane 7 causes this membrane to deform toward the chamber 5 and the pushbutton A to move upward according to FIG. 1. The liquid of the chamber 5 is discharged through the orifice E5.

The end 36*b* of the spring 36 remains pressing against the upper transverse wall of the housing 43 and holds the slide valve 16 in this position.

The raising of the pushbutton A causes the end 36*a* of the spring 36 to rise. When the end 36*a* passes while rising, according to FIG. 1, the horizontal plane passing through the shaft 38 of articulation of the link rod 37, the latter switches over relative to the pushbutton A such that the end 36*a* passes over the shaft 38 when looking at FIG. 1.

Figure 8:
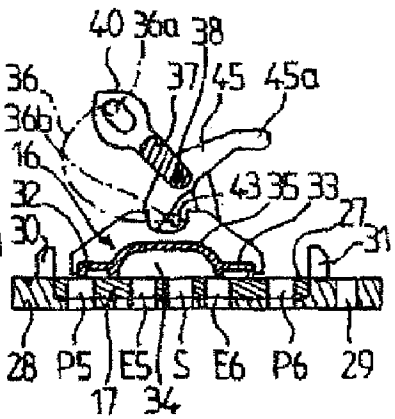
FIG. 8 shows, like FIG. 6, the link rod switched over.
Figure 9:
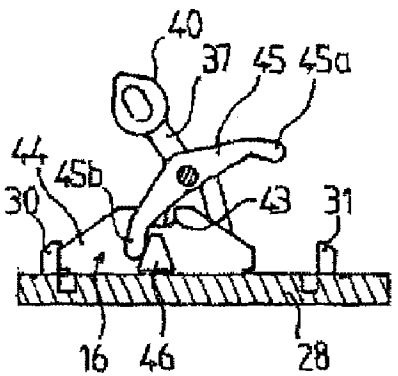
FIG. 9 is a view in elevation of the link rod and the slide valve of FIG. 8.

This step is represented schematically in FIG. 8, brought to the horizontal. The end 36*b* of the spring moves into the housing 43 in order to press against the other transverse wall of the housing 43 and exert a pressure on the slide valve 16 in order to move it toward the other stable position. Thanks to the geometry provided for the link rod 37 and the arms 45, the end 45*b* of these arms simultaneously presses against the stop 46 (FIG. 9). This synchronous attack of the slide valve 16 assists the force of the spring in order to overcome the resistance to sliding of the slide valve 16.

Figure 10:
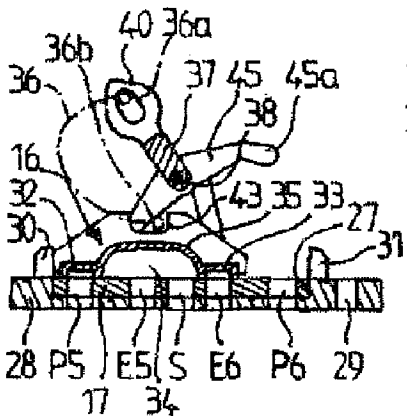
FIG. 10 is a schematic section similar to FIG. 8 of the link rod and the slide valve during sliding.
Figure 11:
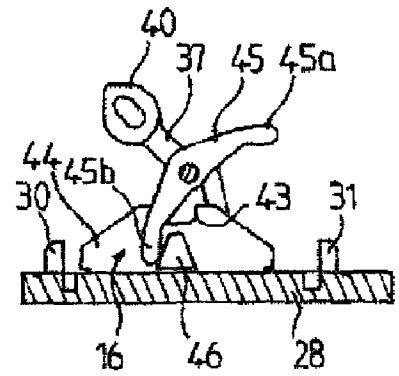
FIG. 11 shows in elevation the slide valve and the link rod in the position of FIG. 10.
Figure 13:
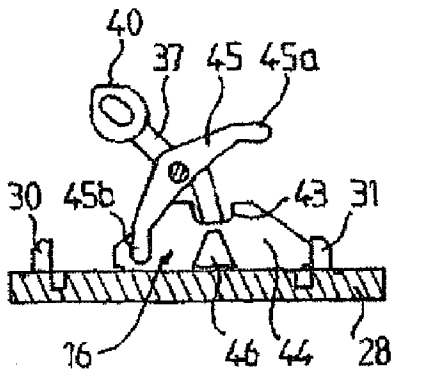
FIG. 13 shows in elevation the slide valve and the link rod in the position of FIG. 12.

FIGS. 10 and 11 represent the relative position of the link rod 37 and of the slide valve 16 at the end of the assistance provided by the arms 45. Since the slide valve 16 has begun its travel, the forces to be developed for it to continue its travel are less. The spring 36 can therefore finish moving the slide valve toward the other stable position and the stop 46 moves away from the end 45*b* as illustrated in FIGS. 12 and 13 which correspond to the top end of travel of the pushbutton A, represented in FIG. 1.

In this other stable position, the pressure is admitted into the chamber 5 while the chamber 6 is connected to the outlet. The membrane 7 can deform downward and the pushbutton A can descend and a new cycle occurs.

The alternating vertical movement of the membrane 7 and of the pushbutton A allows the pumping and metering of the additive thanks to the metering subassembly 21 whose pumping piston 24 is driven by the membrane 7.

The slide valve 16 is held in place against the glass sheet 17 by the spring 36. In addition, the slide valve is pressed against the glass sheet 17 by the pressure difference and the inlet flow of the liquid when the liquid is flowing. The flatness and surface finish of the slide valve 16 and of the glass sheet 17 ensure a good seal between the two elements.

The slide valve 16 sustains a force at right angles to the glass sheet 17 equal to the bearing surface multiplied by the pressure difference. The force to move the slide valve 16 is a transverse force that is equal to the force at right angles to the slide valve 16 multiplied by the friction coefficient between slide valve 16 and glass sheet 17.

The movement of the membrane 7 is mechanically connected and synchronized with the triggering of the switching. The movement of the distribution slide valve on the glass sheet 17 is generated by the rotary movement of the compression spring 36 which "balances" the forces either to the first stable position or to the second stable position, thereby generating the movement of the slide valve 16 by sliding.

The metering subassembly 21, connected to the membrane 7 via the pushbutton 8, sucks then directly injects the additive product at the outlet of the metering device.

The link rod 37, driven by the pushbutton A, compresses the spring 36 and synchronizes the slide valve 16.

Specifically, in certain limiting conditions (pressure, flow), the spring 36 may not be sufficient to cause sliding of the slide valve 16 on which a pressure difference (pressure at the inlet 14 of the metering device minus the pressure at the outlet 18) is exerted. The assistance provided by the link rod and the arms 45 forms a synchronization which makes it possible to ensure switching in these conditions: the slide valve is sufficiently pushed by the arms 45 toward the intermediate position, illustrated in FIGS. 10 and 11 and in FIG. 4, placing all the chambers of the membrane in communication with the outlet and causing the pressure difference to fall. The forces on the slide valve 16 fall and the spring 36 causes the travel of the slide valve 16 to continue toward the other stable position causing the switching. In the event of a pressure difference and/or flow that is too high between the inlet and the outlet of the metering device, or if there is a breakage of the spring 36, the slide valve 16 is placed by the arms 45 in the intermediate position illustrated in FIG. 4 with the two chambers 5, 6 placed in communication with the outlet, and therefore the inlet 14 placed in communication with the outlet 18. The main flow of liquid is not interrupted.

A membrane metering device according to the invention may have a very low flow rate, for example 2 to 3 liters/hour. It may operate under a low water pressure corresponding for example to 1 to 2 meters of head between the water source and the metering device, that is approximately 0.1 to 0.2 bar.

Such a metering device makes it possible to move particle-filled waters, particularly thanks to the operation with membrane.

The flow rate range is very wide, able to go from 2-3 l/h to 2000 l/h for example. The operating pressure range is equally wide, for example from 0.1 bar to 4 or 5 bar.

The metering of additive in the main liquid may be of the order of 2% and even 5%.

As an indication, the cylinder capacity (flow per upward or downward cycle) may be approximately 0.4 liter. The diameter of the membrane may be of the order of 110 mm and the travel from 25 to 30 mm. The orifices in the plate 17 may have a section of approximately 1.3 $cm^2$.

The membrane metering device with switching by distribution slide valve makes it possible to thoroughly separate the distribution mechanism from the piston or membrane driving portion. Accordingly, these elements can be removed independently of one another.

The invention claimed is:

1. A hydraulic machine, in particular a hydraulic motor, comprising:

a casing (2) comprising a body (3) and a cover (4);

a separation means (M) suitable for making an alternating movement in the casing between the body and cover, this separation means defining two chambers (5, 6);

hydraulic switching means (C) for the supply with liquid and the emptying of the chambers, these switching means comprising a distribution member (D) that is able to take two stable positions and is controlled by the movements of the separation means;

a compartment (13) in the body of the casing connected to a pressurized liquid inlet and in which the switching means (C) are housed, and triggering means (15), comprising a pushbutton (A) connected to the separation means, suitable for initiating, at the end of travel, a sudden change of the position of the switching means, under the action of an elastic means (E), for the inversion of travel, characterized in that the distribution member (D) comprises a distribution slide valve (16) pressed against a flat plate (17) that is fixed relative to the body of the casing, the distribution slide valve (16) being able to slide sealingly, without a seal, against the plate (17) which comprises orifices connected respectively to the chambers (5, 6) of the casing and to an orifice (18) for the outlet of the liquid, the distribution slide valve (16) being provided in order, depending on its position, to close certain of the orifices or place them in communication with the fluid inlet or the exhaust.

2. The machine as claimed in claim 1, characterized in that the elastic means (E) consists of a spring (36) in the shape of an arc of a curve of which one end (36*a*) is connected to a link rod (37) articulated on a shaft (38) supported by the body (3) of the casing, one end (40) of the link rod being connected to the pushbutton (A), while the other end (36*b*) of the spring is connected in translation to the slide valve (36), this other end (36*b*) moving from one stable position to another stable position by deformation of the spring (36).

3. The machine as claimed in claim 2, characterized in that the link rod (37) is fixedly attached to at least one arm (45) pressing against a stop (46) of the slide valve (16) at the time of the inversion of the direction of movement in order to assist the force of the spring at the beginning of the movement of the slide valve.

4. The machine as claimed in claim 2, characterized in that the end (36*a*) of the spring in the shape of an arc of a curve connected to the pushbutton (A) travels, during the movement of the pushbutton (A), from one side to the other of the shaft (38) of articulation of the link rod.

5. The machine as claimed in claim 2, characterized in that the end (36*b*) of the spring in the shape of an arc of a curve connected to the slide valve (16) is received in a housing (43) lying in the direction of movement of the slide valve.

6. The machine as claimed in claim 2, characterized in that the spring (36) is made of plastic, and articulation pins provided at each end (36*a*, 36*b*) are molded in a single piece with this spring.

7. The machine as claimed in claim 1, characterized in that the flat plate (17) comprises five orifices spaced out in the direction of sliding of the slide valve (17), namely a central orifice (S) connected to the outlet (18) of the hydraulic machine and, on either side of the central orifice, two spaced out orifices (E5, P5; E6, P6) connected to a chamber (5, 6) of the machine, the slide valve (16) comprising at its longitudinal ends a means (32, 33) for shutting off an orifice of the plate and, between its ends, a space (34) for communication between at least two orifices of the plate.

8. The machine as claimed in claim 7, characterized in that the spacing between the central orifice (S) and an adjacent orifice (E5, E6) of the plate is less than the spacing between this adjacent orifice (E5, E6) and the end orifice (P5, P6) situated on the same side, the communication space (34) of the slide valve ensuring, during the inversion of the direction of movement of the separation means (M), that the two chambers (5, 6) are placed in communication with the outlet (18) and hence that the inlet (14) is placed in communication with the outlet (18).

9. The machine as claimed in claim 7, characterized in that each means for shutting off the slide valve (16) consists of a shutoff zone (32, 33) delimited by two walls transverse to the direction of movement, suitable for closing an orifice of the plate when it is in line with this orifice, and the communication space (34) of the slide valve, comprised between the shutoff zones, is limited by a wall (35) at a distance from the plate.

10. The machine as claimed in claim 1, characterized in that the slide valve (16) and the flat plate (17) are placed parallel to the direction of movement of the pushbutton (A).

11. The machine as claimed in claim 1, characterized in that the surface of the flat plate (17) in contact with the slide valve (16) is a glass sheet.

12. The machine as claimed in claim 1, characterized in that the flat plate (17) is made of ceramic.

13. The machine as claimed in claim 1, characterized in that the distribution slide valve (16) is made of plastic.

14. The machine as claimed in claim 1, characterized in that the separation means is a membrane (7).

15. A proportional metering device for liquid, characterized in that it comprises a hydraulic motor as claimed in claim 1, and an additive-metering subassembly (21) actuated by the motor.

16. The metering device as claimed in claim 15, characterized in that it comprises a separation plug (25) provided in the bottom of the compartment (13) containing the switching means (C), this plug (25) being traversed by a piston (24) of the metering subassembly (21) connected to the pushbutton (A) and a pipe (26) emerging beneath the plug (25) and connected to the outlet (18).

17. The machine as claimed in claim 3, characterized in that the end (36*a*) of the spring in the shape of an arc of a curve connected to the pushbutton (A) travels, during the movement of the pushbutton (A), from one side to the other of the shaft (38) of articulation of the link rod.

18. The machine as claimed in claim 3, characterized in that the end (36*b*) of the spring in the shape of an arc of a curve connected to the slide valve (16) is received in a housing (43) lying in the direction of movement of the slide valve.

19. The machine as claimed in claim 3, characterized in that the spring (36) is made of plastic, and articulation pins provided at each end (36*a*, 36*b*) are molded in a single piece with this spring.

20. The machine as claimed in claim 8, characterized in that each means for shutting off the slide valve (16) consists of a shutoff zone (32, 33) delimited by two walls transverse to the direction of movement, suitable for closing an orifice of the plate when it is in line with this orifice, and the communication space (34) of the slide valve, comprised between the shutoff zones, is limited by a wall (35) at a distance from the plate.

* * * * *